United States Patent [19]

van de Pas et al.

[11] Patent Number: 4,530,780

[45] Date of Patent: Jul. 23, 1985

[54] LIQUID DETERGENT COMPOSITION CONTAINING STABILIZING ELECTROLYTE MIXTURES

[75] Inventors: Johannes C. van de Pas; Frederik van Voorst Vader, both of Vlaardingen; Wilhelmina K. Toet, The Hague, all of Netherlands

[73] Assignee: Lever Brothers Company, New York, N.Y.

[21] Appl. No.: 439,959

[22] Filed: Nov. 8, 1982

[30] Foreign Application Priority Data

Nov. 16, 1981 [GB] United Kingdom ..... 8134409

[51] Int. Cl.[3] ..... C11D 3/14; C11D 9/20

[52] U.S. Cl. ..... 252/528; 252/95; 252/99; 252/103; 252/173; 252/174.14; 252/174.21; 252/135; 252/529; 252/540; 252/547; 252/548; 252/559; 252/DIG. 14

[58] Field of Search ..... 252/550, 551, 554, 555, 252/557, 558, 559, 531, 532, 535, 536, 539, 540, 99, 95, 529, 528, 547

[56] References Cited

U.S. PATENT DOCUMENTS

| | | | |
|---|---|---|---|
| 3,346,873 | 10/1967 | Herrmann | 252/174.24 X |
| 3,574,122 | 4/1971 | Payne et al. | 252/540 |
| 3,985,687 | 10/1976 | Inamorato et al. | 252/551 |
| 4,018,720 | 4/1977 | Lengyel et al. | 252/534 |
| 4,070,309 | 1/1978 | Jacobsen | 252/547 |
| 4,228,043 | 10/1980 | van den Brom | 252/529 |
| 4,244,840 | 1/1981 | Straw | 252/540 |
| 4,302,347 | 11/1981 | Straw et al. | 252/116 |

OTHER PUBLICATIONS

Maston, Ted P. et al., "The Formulation of Non-Built Heavy-Duty Liquids", Part 1 (A) & (B), Soap & Chemical Specialties, Nov. 1979, pp. 33-36, 52, 54 and Dec. 1979, 41-42, 42A, 42B.

*Primary Examiner*—Prince E. Willis

*Attorney, Agent, or Firm*—Milton L. Honig; James J. Farrell

[57] ABSTRACT

The invention pertains to aqueous liquid detergent compositions of the suspending type which comprise a nonionic detergent active material and/or derivative thereof in admixture with an anionic detergent active material and/or cationic detergent active material, and electrolytes which consist of one or more salting-out electrolytes and one or more auxiliary electrolytes having a lyotropic number of 9.5 or above, the combination of said salting-out and auxiliary electrolytes giving improved stability.

2 Claims, No Drawings

LIQUID DETERGENT COMPOSITION CONTAINING STABILIZING ELECTROLYTE MIXTURES

The present invention relates to an aqueous liquid detergent composition of the suspending type, i.e. a composition in which particles of a different density can be suspended.

More particularly the invention relates to an aqueous liquid detergent composition of the suspending type, said composition comprising a nonionic detergent active material and/or a derivative thereof in admixture with an anionic detergent active material and/or a cationic detergent active material, said composition comprising electrolytes.

Such compositions are known in the art, and a typical example of such a composition is an aqueous built liquid detergent composition comprising one or more builder salts. It is well known that the formulation and manufacture of such aqueous built liquid detergent compositions of the suspending type require measures to arrive at a satisfactorily stable (=non phase separating) product; such special measures are for example a critical balancing of the various ingredients, the use of special stabilizers, the use of special processing steps and the like. Analogous phase separation problems can occur with electrolytes other than builder salts, such as buffer salts, fillers and the like.

During the investigation of aqueous liquid detergent compositions of the suspending type, comprising a mixture of an anionic and a nonionic detergent active material, as well as electrolytes, we have noticed that, when instability problems occurred, this was frequently accompanied by a lowering of the cloud point of the nonionic detergent active material caused by the electrolytes present. These electrolytes, at the levels used, cause a salting-out effect on the nonionic detergent active material.

We have now found that the instability problems of such liquid compositions can be significantly reduced by inclusion in such compositions of an inorganic auxiliary electrolyte, the corresponding sodium salt having a lyotropic number of 9.5 and above (as determined by the method of Bruins, Proc. Acad. Amsterdam, 35, 107 (1932) on agar-agar and gelatin). By the use of such an auxiliary electrolyte, the instability of a liquid composition comprising a nonionic detergent active material and/or a derivative thereof, in admixture with an anionic detergent active material and/or a cationic detergent active material and a salting-out electrolyte, can be significantly reduced. There is no definite upper value of the lyotropic number; this value is primarily governed by practical considerations, such as type of electrolyte desired in the composition, especially type of the anion, etc. Usually the upper value will be about 14, preferably 13.3.

Accordingly, the present invention therefore relates to an aqueous liquid detergent composition of the suspending type, said composition comprising a nonionic detergent active material and/or a derivative thereof in admixture with an anionic detergent active material and/or a cationic detergent active material, and electrolytes, the electrolytes consisting of a mixture of one or more electrolytes having a salting-out effect on the nonionic detergent active material or a derivative thereof, and one or more auxiliary electrolytes, the latter having a lyotropic number as hereinbefore defined. The invention will be discussed below in more detail.

It is well known that the extent to which a nonionic detergent active or derivative thereof is salted out by a salting-out electrolyte, resulting in a certain lowering of the cloud point, is dependent upon the nature and the amount of salting-out electrolyte used. In general the composition may contain from 1 to 60% by weight, and preferably from 3 to 50% by weight, and particularly preferably from 5 to 30% by weight of the salting-out electrolytes.

Typical examples of such salting-out electrolytes are water-soluble builder salts, such as the alkali metal ortho- and pyrophosphates, the alkali metal tripolyphosphates, such as sodium tripolyphosphate, the alkali metal silicates, -borates, -carbonates, -sulphates, alkali metal citrates; alkali metal salts of nitrilotriacetate; alkali metal salts of carboxymethyloxy succinate. Instead of the alkali metal salts, the ammonium salts can be used.

The invention is particularly applicable to compositions which contain sodium tripolyphosphate and/or sodium (di)silicate as the salting-out electrolyte.

Depending upon type and level of salting-out electrolyte used, a certain level and/or type of auxiliary electrolyte is required. This can be determined by routine experimentation, using the general indications below as to level and type of auxiliary electrolytes, as also further exemplified in the Examples.

Typical examples of suitable auxiliary electrolytes are alkali metal iodides, alkali metal (per)chlorates, alkali metal rhodanides, and alkali metal nitrates, and alkali metal bromides and -chlorides. The corresponding ammonium salts can also be used. The auxiliary electrolyte is generally used in the composition in an amount of 0.5 to 35% by weight, preferably 1 to 30% by weight, and particularly preferably 2 to 25% by weight.

The total level of electrolyte present in the composition can vary from 1.5 to 70% by weight.

The anionic, cationic and nonionic detergent active materials used in the present invention can be any suitable well-known material. The anionics comprise the well-known anionic detergents of the alkylaryl sulphonate type, the alkyl sulphate type, the alkane- and alkene sulphonate type and so on. Numerous other examples can be found in Schwartz, Perry, Vol. II, 1958, "Detergents and Surface-Active Agents".

The nonionics comprise ethylene oxide and/or propylene oxide condensation produces with alcohols, alkylphenols, fatty acids, fatty acid amides; the above-mentioned reference gives further examples of nonionics. Fatty acid mono- and dialkylol amides, as well as tertiary amine oxides are also included in the terminology of nonionic detergent active compounds.

As derivatives of nonionic detergent active materials, those compounds are contemplated that are derived from nonionics, such as sulphated, phosphonated or carboxylated nonionics.

Examples of cationic detergents are the quaternary ammonium compounds, such as di(higher alkyl)di(-lower alkyl)ammonium halides.

Although cationics can be used according to the present invention in combination with the nonionics, it is preferred to use anionics in combination with the nonionics.

The ratio of anionic to nonionic may vary from 10:1 to 1:10, preferably 5:1 to 1:1, and the total amount of active detergent material may vary from 2 to 50, preferably from 5 to 35% by weight.

The compositions of the invention may furthermore comprise all the other detergent ingredients usually encountered in such products, such as enzymes, fluorescers, soil-redeposition agents, germicides, opacifiers, suds boosters, foam depressants, corrosion inhibitors, perfumes, bleaching agents, bleach precursors, solvents, and so on. They are suitable for stably suspending particulate material, such as insoluble particulate material like zeolites, abrasive materials like calcite, and undissolved particulate builder salts.

The compositions of the invention have an alkaline pH, normally in the range of 7 to 13.

The invention will be further illustrated by way of Example.

EXAMPLE 1

A stock solution was prepared comprising:

16.9% by weight of dodecyl benzene sodium sulphonate 3.9% $C_{13}$–$C_{15}$ primary alcohol, condensed with 11 moles of ethylene oxide 79.2% distilled water The anionic/nonionic ratio was 4.3 and the total active detergent content abt. 20%.

To 100 g of this stock solution were added 16 g of a 32% aqueous solution of sodium disilicate ($Na_2O$:SiO 2.1) (composition A), 16 g of the same sodium disilicate solution plus 9 g of sodium iodide (lyotropic number 12.5) (composition B), and 16 g of the same sodium disilicate solution plus 18 g of sodium iodide (composition C).

These compositions were stored at room temperature and assessed for their storage stability. (Stable = ≦1% phase separation; unstable ≧3% phase separation).

Composition A was already unstable after less than 1 hour; compositions B and C were still stable after 6 months.

Increasing the disilicate solution level in A, B and C to 32 g, and using 6 and 9 NaI in B and C gave products which were unstable after 1 hour ($A^1$), stable for 1 month ($B^1$) and stable for more than 6 months ($C^1$).

Using a mixture of 16 g of disilicate solution and 4.2, 5.6, 8.2 or 16.8 g of sodium perchlorate (lyotropic number 11.6) in 100 g stock solutions gave products which were all stable for more than 3 months.

EXAMPLE 2

Using 5 g of trisodium carboxy methyloxy succinate $5H_2O$ ("CMOS") in 100 g of the stock solution (composition D), 5 g of CMOS + 11.2 g of sodium perchlorate (composition E) or 5 g of CMOS plus 22.4 g of sodium perchlorate in 100 g of the stock solution (composition F) gave the following results:

D: unstable after 1 day

E: stable for more than 3 months

F: stable for more than 3 months

EXAMPLE 3

A stock was prepared comprising:

16.9% by weight of dodecyl benzene sodium sulphonate 3.9% $C_{13}$–$C_{15}$ primary alcohol, condensed with 11 moles of ethylene oxide 79.2% distilled water The anionic/nonionic ratio was 4.3 and the total active detergent content was abt. 20%.

To 100 g of the stock solution were added 12.5 g of sodium tripolyphosphate and 6 g of sodium disilicate. This composition (G) was unstable within 3 days. Addition of the auxiliary electrolytes to composition G gave the following results:

| Auxiliary electrolyte | Stability (days) Amount of auxiliary electrolyte added (moles) to 118.5 g of composition G | | | | | | |
|---|---|---|---|---|---|---|---|
| | 0.02 | 0.03 | 0.04 | 0.06 | 0.08 | 0.12 | 0.16 |
| Na I | >90 | 80 | >90 | 80 | 80 | >90 | >90 |
| NaBr (Lyotropic number 11.3) | <3 | 3 | 10 | 50 | 90 | 50 | 50 |
| $NaNO_3$ (Lyotropic number 11.8) | <3 | <3 | >90 | >90 | >90 | <3 | <3 |

To 100 g of this stock solution were added 25 g of sodium tripolyphosphate and 7.5 g of sodium disilicate. This composition (H) was unstable within 3 days. Addition of the auxiliary electrolytes to composition H gave the following results.

| Auxiliary electrolyte | Stability (days) Amount of auxiliary electrolyte added (moles) to 132.5 g of composition H | | | | | | |
|---|---|---|---|---|---|---|---|
| | 0.02 | 0.03 | 0.04 | 0.06 | 0.08 | 0.12 | 0.16 |
| NaI | 20 | 70 | >90 | 55 | 85 | 60 | <3 |
| NaBr | <3 | <3 | <3 | 15 | 20 | 75 | 75 |
| $NaNO_3$ | <3 | <3 | <3 | 35 | 10 | <3 | <3 |

EXAMPLE 4

A stock solution was prepared comprising:

14.7% by weight of dodecyl benzene sodium sulphonate 5.9% $C_{12}$–$C_{15}$ primary alcohol condensed with 7 moles of a mixture of ethylene- and propylene oxide containing 92% ethylene oxide 79.4% distilled water.

The anionic/nonionic ratio was 2.5 and the total active detergent content was abt. 20%.

To 100 g of this stock solution were added 25 g of sodium tripolyphosphate and 7.5 g of sodium disilicate. This composition (K) was unstable within 3 days. Addition of the auxiliary electrolytes to composition K gave the following results:

| Auxiliary electrolyte | Stability (days) Amount of auxiliary electrolyte added (moles) to 132.5 g of composition K | | | | | | |
|---|---|---|---|---|---|---|---|
| | 0.02 | 0.03 | 0.04 | 0.06 | 0.08 | 0.12 | 0.16 |
| NaI | 15 | >90 | >90 | 60 | 60 | 60 | 60 |
| NaBr | <3 | 10 | 35 | >90 | >90 | 40 | >90 |
| $NaNO_3$ | 15 | 15 | 15 | 3 | 10 | >90 | 20 |

EXAMPLE 5

A stock solution was prepared comprising 10.7% by weight of dodecyl benzene sodium sulphonate 10% coconut diethanol amide 79.3% water The anionic/nonionic ratio was 1.1 and the total active detergent content abt. 20% .

To 100 g of this stock solution were added 8 g of sodium orthophosphate, 4 g of sodium triphosphate and 10 g sodium disilicate. This composition (L) was unstable within 1 day. Addition of the auxiliary electrolyte to composition L gave the following results:

| Auxiliary electrolyte | Stability (days) Amount of auxiliary electrolyte added (moles) to 122 g of composition L | | | | |
|---|---|---|---|---|---|
| | 0.025 | 0.04 | 0.07 | 0.11 | 0.15 |
| NaCNS (lyotropic number 13.3) | >65 | >65 | 35 | 15 | 7 |
| NaI | >90 | >90 | 35 | 20 | 20 |
| $NaNO_3$ | 20 | 65 | >90 | 70 | 40 |
| $NaClO_3$ (lyotropic number 10.6) | 50 | 20 | 65 | 30 | 15 |
| NaCl (lyotropic number 10.0) | <1 | >90 | 40 | 10 | 3 |

We claim:

1. An aqueous built liquid detergent composition of the suspending type which comprises:

(i) 5 to 35% by weight of a detergent active material comprising:

(a) a nonionic detergent active material selected from the group consisting of tertiary amine oxides, alkylene oxide condensation products of alcohols, alkyl phenols, fatty acids and of fatty acid amides; and (b) an anionic detergent active material, a cationic detergent active material or mixtures thereof;

wherein the weight ratio of component (a) to component (b) lies between 1:1 and 1:5; and (ii) a mixture of electrolytes, said mixture comprising:

(a) 5 to 30% by weight of an electrolyte having a salting-out effect on component (a) of said nonionic detergent active material, selected from the group consisting of the alkali metal and ammonium salts of orthophosphates, pyrophosphates, tripolyphosphates, silicates, disilicates, borates, carbonates, sulfates, citrates, nitrilotriacetates, carboxymethyloxy succinates and mixtures thereof; and (b) 2 to 25% by weight of an auxiliary electrolyte having a lyotropic number of at least 9.5, selected from the group consisting of the alkali metal and ammonium salts of iodides, chlorates, perchlorates, rhodanides, nitrates, bromides, chlorides and mixtures thereof.

2. A composition according to claim 1, wherein said salting-out electrolyte is selected from the group consisting of sodium tripolyphosphate, sodium silicate, sodium disilicate and mixtures thereof.

* * * * *